United States Patent [19]

Vick

[11] 4,433,615

[45] Feb. 28, 1984

[54] BLOCKING AND THERMAL RELIEF VALVE

[75] Inventor: Ralph L. Vick, Granada Hills, Calif.

[73] Assignee: The Bendix Corporation, Southfield, Mich.

[21] Appl. No.: 313,896

[22] Filed: Oct. 22, 1981

[51] Int. Cl.[3] ..... F15B 13/042

[52] U.S. Cl. ..... 91/420; 137/508; 137/106; 137/596.2

[58] Field of Search ..... 91/419, 420, 447, 453; 137/508, 106, 596.2

[56] References Cited

U.S. PATENT DOCUMENTS

| | | | |
|---|---|---|---|
| 2,845,088 | 7/1958 | Crausman et al. | 137/508 |
| 3,098,443 | 7/1963 | Spencer | 137/508 |
| 3,450,155 | 6/1969 | Froehner et al. | 137/508 |
| 3,792,715 | 2/1974 | Parrett et al. | 91/420 |
| 3,993,361 | 11/1976 | Stelzer | 137/508 |

FOREIGN PATENT DOCUMENTS

| | | | |
|---|---|---|---|
| 2424973 | 12/1975 | Fed. Rep. of Germany | 91/420 |
| 1044206 | 9/1966 | United Kingdom | 91/420 |

*Primary Examiner*—Martin P. Schwadron
*Assistant Examiner*—Richard L. Klein
*Attorney, Agent, or Firm*—Robert C. Smith; W. F. Thornton

[57] ABSTRACT

A combination hydraulic lock and pressure relief valve for use in an actuator system for operating a spoiler control surface is interposed between the retract side of the actuating piston and the servo valve controlling the piston. In this valve a poppet urged closed against a seat member by means of a light spring aided by the fluid pressure in the retract chamber of the piston holds the poppet closed whenever the system is shut down. A piston exposed to supply pressure carries a spring retainer which includes an elongated rod movable to dislodge the poppet from its seat to permit fluid to move toward and from the retract side of the piston during normal operation of the spoiler. A second retainer abuts against the seat and a heavy spring is interposed between the spring retainers. The seat member is loaded by the heavy spring to a predetermined level above normal system pressure. Differential operating areas are chosen such that when fluid pressure in the retract chamber increases to exceed the predetermined level this pressure, operating against the seat, causes the seat to move away from the poppet, thus relieving the overpressure condition.

6 Claims, 1 Drawing Figure

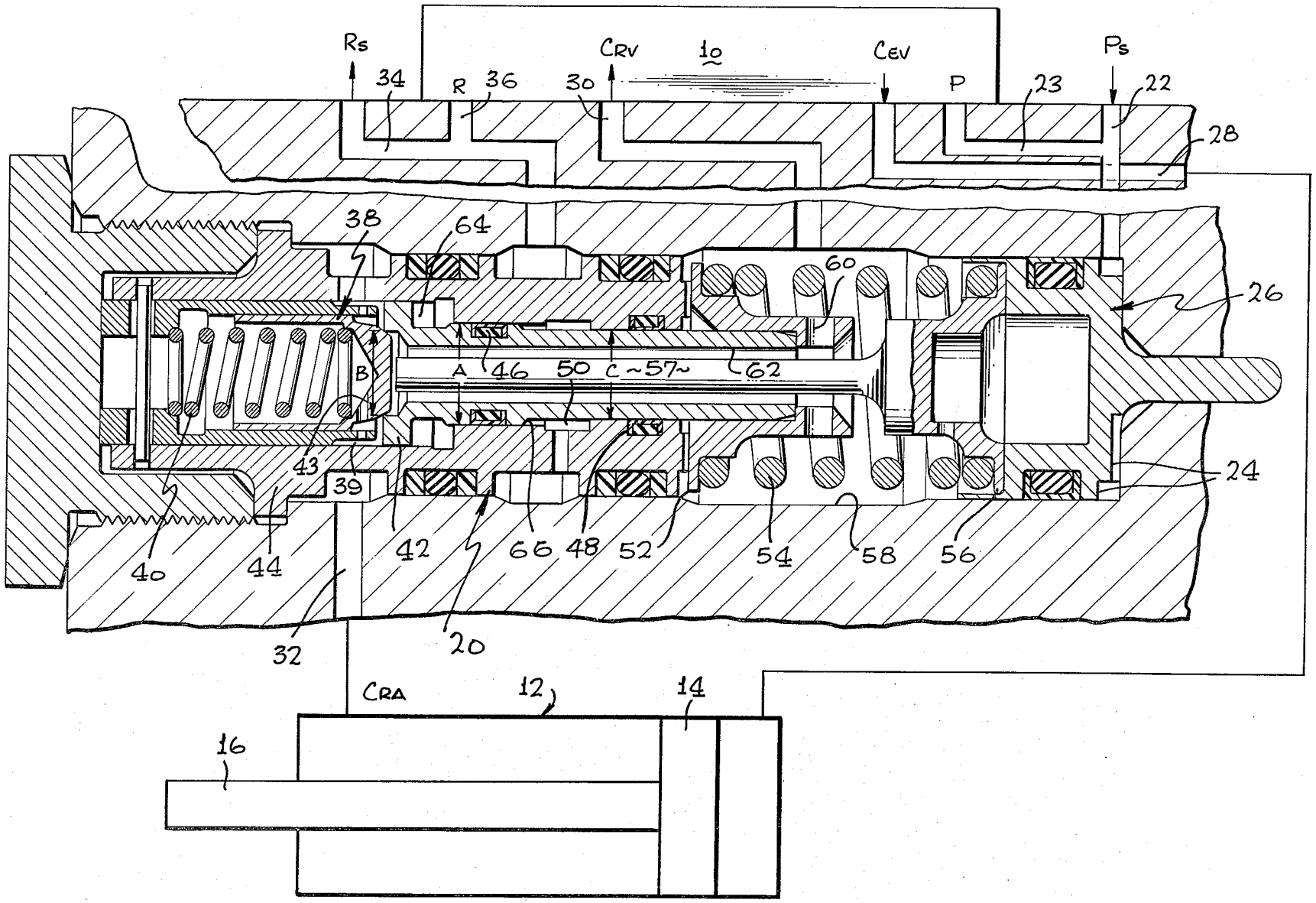
Ps
22
28
23
P
CEV
10
CRV
30
36
R
34
Rs
26
24
56
58
60
54
62
57
C
52
50
48
46
66
A
64
20
42
38
B
39
43
44
40
32
CRA
14
12
16

BLOCKING AND THERMAL RELIEF VALVE

This invention relates to a blocking and thermal relief valve used in hydromechanical servo systems such as are employed for operating spoilers in aircraft. A typical such servo system may include a first stage electro-hydraulic servo valve which controls the fluid pressure from a pump to a second stage spool type servo valve. The second stage spool valve has a number of lands for directing operating fluid under pressure to and from opposite sides of an actuating piston in a hydraulic cylinder. The actuating piston normally carries a rod which is translated with the piston to control the position of a member such as an aircraft spoiler control surface. In this application it is the function of the hydraulic cylinder and piston to alternately direct and exhaust fluid under pressure to and from each side of the actuator piston for extending and retracting the actuator to cause raising and lowering of the spoiler and also to hold the spoiler in selected positions. It is a known practice in such systems to incorporate a blocking valve between the servo valve and the retract (or rod) side of the piston to prevent raising of the spoiler by aerodynamic forces thereon in case system pressure fails or in case external forces tending to raise the spoiler results in retract pressure exceeding system pressure when the latter is below the normal operating pressure.

It is also known in hydraulic systems for aircraft spoilers to provide a thermal relief valve between the retract side of the actuator piston and the system reservoir for relieving excess pressure on the retract side of the piston caused by thermal expansion of the hydraulic fluid when the lock valve is closed. The thermal relief valve may also function as an overload relief valve to relieve excess fluid pressure in the retract side of the piston generated by forces on the spoiler tending to extend the piston when the lock valve is closed.

In earlier systems the blocking and relief valves were arranged such that they were subject to the full pressure differential between the reservoir pressure and the desired relief pressure. Under these conditions in a 3000 psi working pressure system, the relief valve opening pressure may have been as high as 3800 psi, which resulted in high velocity flow across the relief valve seat each time the relief valve opened, resulting in rapid erosion of the seat and, ultimately, constant leakage when the relief valve was closed. Earlier designs have dealt with this problem by providing at least partial balancing across the relief valve so that when the excess fluid pressure in the retract side of the piston was relieved through opening of the relief valve, the downstream pressure was at some substantial value so that the pressure differential was substantially less than the full 3800 psi, for example.

During operation of the aircraft while the hydraulic system pressure is utilized for holding the spoiler in a down position, aerodynamic forces on the spoiler will tend to raise it. These forces may impose sufficient extending force on the actuator piston to increase the pressure on the retract side close to, or even higher than, system pressure when the latter has been temporarily reduced due to flow demands of other components of the hydraulic system. When this occurs, the blocking valve closes to trap the fluid in the retract chamber and prevent extension of the piston and raising of the spoiler. Occasionally, due to surges in the system pressure, the pressure in the retract side may pulse to a pressure that exceeds the opening pressure of the relief valve, and the latter will then open to prevent a further rise in pressure in the retract chamber. Since the environment in which the cylinder and piston are located is often hot and subject to heat soaking during operation or when the system is shut down, the thermal effects may result in increases in pressure in the retract chamber exceeding the relief valve pressure, and in such case the relief valve will operate to reduce the pressure in the same manner as set forth above.

Hydraulic blocking and relief valves have been in use with aircraft spoiler control surfaces for many years, but not all such valves have provided all the above listed desirable functions. One such valve was capable of providing most of the above listed desirable functions, but when the system was shut down it did not always close and block the flow from the cylinder before the system pressure fell to a value below that required to support the control surface in a desired position. This occasional malfunction was believed caused by friction loading from a plurality of seals required in that particular design.

A later design overcame the above disadvantage by eliminating some seals, but it was expensive to produce because it included pistons in cylinders which were so arranged that costly concentric lapped surfaces were required.

It is, therefore, an object of the present invention to provide a blocking and thermal relief valve for aircraft spoiler controls which will consistently close before system pressure falls to a pressure value below that required to support the "hold down" hinge moment; i.e., irrespective of the value of system pressure a somewhat lower pressure at the servo return line will allow the valve to close.

It is another object of the present invention to provide a blocking and thermal relief valve which will accomplish the above described blocking and relief functions and which can be built within the same envelope as previous designs without requiring the making of costly concentric lapped surfaces.

It is a further object of the present invention to provide a blocking and thermal relief valve which meets the above objectives and which provides for a larger control area against which over-pressures operate to initiate the relief valve function without requiring a larger overall size of valve than previous designs now in use.

It is a further object of the present invention to provide a blocking and thermal relief valve which accomplishes the above objectives with fewer fluid connections and fewer and smaller seals than required with certain recent designs.

Other objects and advantages will become apparent from the following specification and drawing, in which:

The single FIGURE is a schematic drawing of a servo control system including a sectional view of a blocking and thermal relief valve according to my invention.

In the drawing a conventional power control servo valve is shown as a block 10 having a number of fluid connections to a hydraulic cylinder 12 containing a piston 14 carrying an output control rod 16, and to a blocking and thermal relief valve 20. Hydraulic fluid under supply pressure ($P_s$) is supplied from a pump, not shown, to a conduit 22 connected to the servo valve 10 through line 23 and to an operating surface 24 of a piston 26 on one end of the blocking and thermal relief valve 20. Servo valve 10 controls the flow of fluid under pressure to and from the head end and the rod end of piston 14. A conduit 28 supplies fluid at a controlled pressure ($C_{EV}$) to the head end of the piston. Fluid at a controlled pressure ($C_{RV}$) is supplied to the rod end of the piston 14 through a conduit 30 to the blocking and thermal relief valve 20, through valve 20, and to the rod end of the piston through a conduit 32 ($C_{RA}$). Hydraulic fluid at system return pressure ($R_s$) is connected through a conduit 34 to the blocking and thermal relief valve 20 and through a connecting line 36 to servo valve 10.

Blocking and thermal relief valve 20 includes a poppet valve 38 in a controlled fluid pressure chamber (lock chamber) 39 which is urged by means of a spring 40 against a seat member 42. Poppet valve 38 includes a port 43 communicating lock chamber 39 with the interior of valve 38, containing spring 40. Seat 42 is retained concentrically within a sleeve 44. A pair of seals 46 and 48 seal return fluid pressure in line 34 and an annulus 50 from control pressures $C_{RA}$ in line 32 and $C_{RV}$ in line 30. At the opposite end of sleeve 44 from poppet 38 and abutting against the sleeve is a spring retainer 52 which retains one end of a spring 54. The opposite end of spring 54 abuts against a retainer 56 movable with piston 26. Retainer 56 is formed with an axially extending rod 57 which passes through the hollow interior of the valve seat member 42, terminating just short of the poppet valve member 38.

The system described herein is biased toward keeping the piston 14 retracted or in its extreme right hand position as shown in the drawing while in the zero command mode. It is desired that the fluid pressure on the left or rod end of the piston 14 be retained even when the system is shut down. This $C_{RA}$ pressure acting within poppet valve member 38 is augmented by the force of spring 40 forces poppet valve member 38 against seat 42, thus blocking any flow from line 32. Because of the bias toward the retract position, the pressure in a chamber 58 communicating with conduit 30 ($C_{RV}$) and which contains spring 54 is, with zero command, essentially the same as the supply pressure $P_s$ in line 22. This pressure ($C_{RV}$) is communicated through ports 60 to an annular chamber 62 within seat member 42 and to a working area on the face of poppet 38 on the inside of its ring of contact with seat 42. Under these conditions there is insufficient fluid pressure differential to overcome the force of spring 54 and piston 26, and member 56 will not move. Thus poppert member 38 remains closed.

During normal operation it is desired that the valve operate to provide flow through the poppet valve to retract the piston 14 and rod 16 and through the opposite direction in the driven/open poppet valve member to extend the piston 14 and rod 16. When it is desired to extend the piston and rod, pressure $C_{RV}$ is low relative to supply pressure $P_s$; therefore, the force from pressure $P_s$ on the piston 26 drives the member 56 and its axially extending rod 57 against the poppet member 38, forcing it away from its seat against the force of spring 40. This permits operating fluid to flow from the rod end of cylinder 12 via conduits 32 and 30 toward the return side of the system as fluid is being supplied under pressure $P_s$ to the head end through conduit 28.

During normal retract operation, the pressure in line 30 ($C_{RV}$) is high but significantly lower than supply pressure $P_s$, and the pressure $C_{EV}$ in conduit 28 will be substantially lower. Because the pressure in conduit 28 is reduced to a low value, piston 14 will begin moving toward the right, thus reducing the fluid pressure in the rod end of cylinder 12 and line 32 ($C_{RA}$). The pressure drop across piston 26 may be sufficient to move retainer 56 and rod 57 toward the left sufficiently to dislodge poppet member 38 from its seat 42, therby permitting flow from line 30 through chambers 58 and 62 and across poppet 38 to conduit 32. In any case flow may occur from $C_{RV}$ through conduit 30, chambers 58 and 62, and across poppet 38 to conduit 32 by providing sufficient pressure differential across poppet 38 against spring 40 to open poppet 38 as in a normal check valve operation.

When the poppet member 38 is closed and the piston 14 is blocked from moving, it sometimes occurs that pressure surges will occur or temperature will increase to a high value in the rod end of cylinder 12, either of which may result in a build-up of fluid pressure in cylinder 12 to a level exceeding the normal supply pressure level $P_s$. As pressure $C_{RA}$ increases, the fluid pressure on the inside (spring chamber) of poppet member also builds, thereby urging the poppet against seat 42. The force of spring 54 is sufficient to hold seat member 42 against the poppet 38 when the system is in the retract mode with system pressure on or off. Pressure $C_{RA}$ is then operative on an annular area of the left hand face of seat member 42 equal to the diameter of bore A minus the diameter of the circle of contact of seat member 42 with poppet 38 which is bore B. Seat member 42 is balanced for changes in $C_{RV}$ because its effective area on the right hand end is essentially the same as bore B. The larger diameter piston on the left end of seat member 42 is not included because it does not fit tightly in its bore and essentially the same fluid pressure builds up behind it in a chamber 64. This piston and chamber 64 act as a hydraulic damper to prevent oscillation which might otherwise occur because of spring forces.

When $C_{RA}$ reaches a predetermined pressure value ("cracking pressure") above $P_s$ it, acting against the annular area defined by the diameter of bore A minus diameter of bore B becomes sufficient to overcome the force of spring 54 and seat member 42, is caused to move to the right away from poppet 38 (which is restrained from following by rod 57), thus relieving the excess pressure $C_{RA}$ in the rod end of cylinder 12. This excess pressure is exhausted very quickly, and the spring 54 will subsequently force the seat member 42 back against the poppet 38, thus continuing to maintain the desired high level of fluid pressure in the rod end of cylinder 12. This relief valve operation can occur whether the hydraulic system is under normal pressure or has been turned off and may occur successively until the rod end pressure is stabilized at a value below the predetermined threshold pressure of the relief valve. As described above, return pressure line 34 is connected to an annulus 50 communicating with an annular working pressure area 66 which has the same area as the diameter of bore A minus the diameter of bore B. This effectively references the relief valve "cracking pressure" to whatever the return pressure R may be—usually atmospheric pressure.

From the foregoing it will be recognized that the present valve design accomplishes the desired blocking and relief functions described above in a reliable and effective manner and requires no excessively costly parts or machining or lapping operations. By using the differential area arrangement described above, an earlier expensive design was further simplified by eliminating one sensing line which had been required.

I claim:

1. In a system for controlling the raising and lowering of an aircraft spoiler control surface including a hydraulic cylinder and piston connected to said spoiler to cause said spoiler to be raised when said piston is in extended position and lowered when said piston is in retracted position, a source of hydraulic fluid under high supply pressure and a servo valve for directing said hydraulic fluid to one side or the other of said piston;

a blocking and relief valve connected between the retract side of said cylinder and said servo valve comprising a housing having an internal chamber, a first piston movable in said housing having a working area exposed to said high pressure source, and means in said chamber defining large, intermediate and smaller diameter bores;

a seat member movable axially within said chamber including a second piston in said large diameter bore and intermediate and smaller diameter sections in said intermediate and smaller diameter bores, respectively, a valve seat on said second piston and an axially directed interior passage, said piston and said large diameter bore functioning as a damping means;

a hollow poppet valve member in said housing and resilient means urging said poppet valve member against said seat;

a lock member in said housing communicating with said seat member and said poppet member and port means communicating said lock chamber with the interior of said poppet member;

a controlled pressure chamber in said housing communicating with said axially directed interior passage;

a first spring retainer movable with said first piston, a second spring retainer operably connected with said seat member, and a spring positioned in said controlled pressure chamber between said second spring retainer and said first spring retainer, said first spring retainer including means movable therewith capable of forcing said poppet member away from said valve seat;

such that when the pressure in said controlled pressure chamber is at a low value said supply pressure moves said first piston and said first spring retainer to open said poppet member; when the pressure in said lock chamber is at a low value said poppet member is caused to open as a result of higher pressure in said controlled pressure chamber; when said supply pressure is at a low value and the pressure in said lock chamber is at a normal working value, said poppet is held against said seat; and when said lock chamber pressure reaches a predetermined pressure above a normal supply pressure value, said predetermined pressure acting on an operating area of said seat member overcomes the force of said spring and forces said seat member away from said poppet.

2. A blocking and relief valve as claimed in claim 1 wherein said operating area on said seat member is equal to the area of said intermediate bore minus the area within the circle of contact of said seat.

3. A blocking and relief valve as claimed in claim 1 wherein said means movable with said spring retainer means is a rod axially movable within said axially directed interior passage to force said poppet member from said seat during normal extension and retraction of said piston and to restrain said poppet from following said seat member when said lock chamber pressure exceeds said predetermined pressure.

4. A blocking and relief valve as claimed in claim 2 wherein said housing includes a return pressure chamber connected to a low pressure source, said chamber surrounding said seat member between said smaller diameter portion thereof and said intermediate diameter bore and exerting a force over an effective area equal to said operating area on said seat member whereby said return pressure serves as a reference pressure for said blocking and relief valve.

5. A blocking and relief valve as claimed in claim 1 wherein said seat member, when closed against said poppet member, is exposed to the pressure in said controlled pressure chamber against equal areas at each end thereof, thereby being balanced for changes in said controlled pressure.

6. A blocking and relief valve comprising a housing including an internal chamber, a piston movable in said chamber having a working area exposed to a high fluid pressure source;

a sleeve member fixed in said chamber axially displaced from said piston having a larger diameter bore, an intermediate diameter bore, and a smaller diameter bore;

a cylindrical seat member movable within said sleeve member having an interior passage, a large diameter piston in said larger diameter bore, an intermediate diameter portion in said intermediate diameter bore, a smaller diameter portion in said smaller diameter bore, and a valve seat on said piston portion of smaller diameter than said intermediate bore;

a hollow poppet member in said housing and resilient means urging said poppet member against said seat;

a lock chamber communicating with said poppet member and port means communicating said lock chamber with the interior of said poppet member;

a first spring retainer movable with said piston including a rod extending through said hollow interior passage terminating near said poppet member, a second spring retainer operably connected to said seat member and a spring urging said first and second spring retainers apart such that said seat member is urged against said poppet;

a controlled pressure chamber in said housing containing said spring retainers and said spring and extending through said interior passage to said seat, and a return pressure chamber connected to a low pressure source, said chamber surrounding said seat member between said smaller diameter portion thereof and the intermediate diameter bore of said sleeve member such that when said controlled pressure is at a low value, said supply pressure is enabled to move said piston and first spring retainer and rod to force said poppet from said seat, when the pressure in said lock chamber is at a low value said poppet is caused to move from said seat as a result of higher pressure in said controlled pressure chamber, when said supply pressure is at a low value and the pressure in said lock chamber is at a normal working value the forces on said poppet hold said poppet on said seat, and when said pressure in said lock chamber is at a predetermined level above said normal working pressure, said pressure acting on an area of said seat member equal to the area of said intermediate bore minus the area defined by the circle of contact of said seat overcomes the force of said spring and forces said seat member away from said poppet.

* * * * *